US006872167B1

(12) United States Patent
Meissner

(10) Patent No.: US 6,872,167 B1
(45) Date of Patent: Mar. 29, 2005

(54) ARTIFICIAL ROCK CLIMBING ARRANGEMENT ADAPTED FOR WATER ENVIRONMENT

(76) Inventor: Richard K. Meissner, W288 N8433 N. Bay Rd., Hartland, WI (US) 53029

( * ) Notice: Subject to any disclaimer, the term of this patent is extended or adjusted under 35 U.S.C. 154(b) by 323 days.

(21) Appl. No.: 10/087,562

(22) Filed: Mar. 1, 2002

(51) Int. Cl.[7] ..... A63B 9/00; A63B 71/00
(52) U.S. Cl. ..... 482/37; 482/35; 482/51
(58) Field of Search ..... 482/35–37, 148, 482/17, 51; 14/75; 446/476; 472/134, 136

(56) References Cited

U.S. PATENT DOCUMENTS

| | | | | |
|---|---|---|---|---|
| 534,704 | A * | 2/1895 | Worden | 14/37 |
| 2,556,175 | A * | 6/1951 | Frost | 14/2.4 |
| 4,848,737 | A * | 7/1989 | Ehrenfield | 482/52 |
| 5,543,185 | A | 8/1996 | Christensen | |
| 6,083,142 | A * | 7/2000 | Wilson | 482/37 |
| 6,193,633 | B1 | 2/2001 | Jonas et al. | |
| 6,231,482 | B1 | 5/2001 | Thompson | |
| 6,322,454 | B1 | 11/2001 | Gordon | |
| 6,390,952 | B1 * | 5/2002 | Wilson | 482/37 |

FOREIGN PATENT DOCUMENTS

WO WO 9531257 A1 * 11/1995

* cited by examiner

*Primary Examiner*—Justine R. Yu
*Assistant Examiner*—Fenn C. Mathew
(74) *Attorney, Agent, or Firm*—Andrus, Sceales, Starke & Sawall, LLP

(57) ABSTRACT

An artificial rock climbing arrangement includes a generally rigid framework removably attached to a support surface located adjacent a body of water. A panel structure is mounted on the framework for defining a climbing surface, the panel surface carrying a plurality of climbing holds. A support structure is secured between the framework and the support surface for maintaining the framework and the climbing surface in a substantially vertical orientation when a climber scales the climbing surface.

15 Claims, 9 Drawing Sheets

ARTIFICIAL ROCK CLIMBING ARRANGEMENT ADAPTED FOR WATER ENVIRONMENT

FIELD OF THE INVENTION

The present invention relates generally to recreational devices and, more particularly, pertains to the adaptation of an artificial rock climbing arrangement to water sport equipment.

BACKGROUND OF THE INVENTION

Rock climbing has increased in popularity tremendously over the last few decades, and with this increase, artificial rock climbing walls have become quite popular. Such walls allow climbers to practice and hone their skills, and allow beginners to experience rock climbing in a safe environment away from dangerous conditions such as high elevations, loose rocks, etc., that exist while climbing actual rock formations. In addition, artificial climbing walls allow purchasers of climbing boots, harnesses, and other equipment to test these articles in a store prior to purchase. Hence, artificial climbing walls are becoming commonplace for indoor gymnasiums, resorts, climbing equipment retail stores, and the like.

A typical artificial climbing structure will have a wall constructed of plywood with T-nuts inserted through the plywood panels to the climbing surface. The T-nuts allow structures called climbing holds to be affixed on the climbing surface in a manner which defines a climbing route. These climbing holds are often threadably fastened to the T-nuts so that the holds can be added, removed or changed to vary the features and difficulty of ascending the artificial wall. The climbing holds are typically made of resin-concrete, and can be shaped as desired. For example, an easy hold would provide a large external ledge, which is easily grabbed or stepped on. A more difficult hold will only extend slightly from the climbing surface, making it more difficult for the climber to support their weight. Today's climbing holds serve a functional, decorative and an entertainment purpose.

More recent advancements and climbing wall structures have enhanced the look and feel of the climbing surface. Initially, the flat plywood panels were often covered with a mixture of sand and paint to more nearly approximate the texture of natural rock. Textured fiberglass panels having molded features that more nearly approximate those of natural walls are also now available. The molded panels incorporate T-nuts or other hold attachment structures so that the difficulty of the various routes can be changed after the panels are assembled. Alternate artificial rock climbing structures make use of polystyrene foam blocks that are attached to support structures and then cut to irregular rock-like shapes. The polystyrene foam can then be covered with a hard coating for climbing. Hence, advancements and artificial climbing structures for use in a fixed location such as a climbing gym, climbing store and the like, have gradually enhanced these practice climbing facilities by providing more realistic walls that closely approximate natural rock formations.

As climbing has further increased in popularity, attempts have been made to provide portable climbing structures that can be set up for temporary use at fairs or other events. Also many colleges and universities have built elaborate artificial rock climbing facilities.

Water sports, lake homes, and larger and more expensive water toys, such as trampolines, aluminum rafts, and specialized water ski equipment, have also increased in popularity. This is due in part to the substantial increase in valuations of lake homes and the growing importance of leisure time. In general, owners of lake homes feel wealthier and can justify the feeling of having more disposable income to enjoy their leisure activities.

In light of the above, it would be desirable to provide improved artificial rock climbing structures and devices. It would be particularly desirable to provide climbing structures that were better suited for use with water sport activities.

SUMMARY OF THE INVENTION

It is a general object of the present invention to provide an artificial rock climbing arrangement which promotes physical exercise and creates a new source of entertainment in a water environment.

It is also an object of the present invention to provide an artificial rock climbing arrangement which is variously attached to an in-water or near water support surface.

It is a further object of the present invention to provide an artificial rock climbing arrangement which is capable of easy installation and removal.

It is another object of the present invention to provide an artificial rock climbing arrangement which is adjustable in height.

It is an additional object of the present invention to provide an artificial rock climbing arrangement which does not require a belaying system.

In one aspect of the invention, an artificial rock climbing arrangement includes a generally rigid framework removably attached to a support surface located adjacent a body of water. A panel structure is mounted on the framework for defining an artificial climbing surface, the panel structure carrying a plurality of climbing holds. A support structure is secured between the framework and the support surface for mounting the framework and the climbing surface in a substantially vertical orientation when a climber scales the climbing surface. The framework has an inverted U-shape and includes a pair of parallel legs connected together by a bight portion. The framework legs have bottom ends provided with mounting devices removably secured to an end of the support surface. In some embodiments, the mounting devices permit pivotable movement of the framework and the climbing surface relative to the support surface. In another embodiment, the mounting devices prevent pivotable movement of the framework and the climbing surface relative to the support surface. The support surface preferably takes the form of a pier or pontoon boat. The framework and the climbing surface are movable between a use position and a non-use position. The panel structure is modular and includes at least two adjacently joined panels removably fastened to the framework. In the preferred embodiment, the support structure includes a pair of support members, each being connected between one leg of the framework and a connecting plate attached to a side of the support surface behind the framework. Each connecting plate has two positions, one for holding the framework and climbing surface at an angle of substantially 90 degrees relative to the support surface, and another for holding the framework and climbing surface at an angle beyond 90 degrees relative to the support surface. In an alternative embodiment, the support structure includes a single support member connected between the bight portion of the framework and a receiver located on a support surface behind the framework.

In the preferred embodiment, each mounting device is comprised of a mounting plate attached to the end of the support surface, the mounting plate having a pair of spaced apart tubular receivers. A triangular bracket is provided on the bottom of each framework leg and has a tubular knuckle disposed between the receivers on the mounting plate. A removable hinge pin is passed through the aligned receivers and knuckle.

In a first alternative embodiment, each mounting device is comprised of a retainer plate fastened on a side of the support surface. An extension plate projects rearwardly on the bottom of each framework leg which rests upon the support surface. A removable hinge pin interconnects the retainer plate with the extension plate.

In a second alternative embodiment, each mounting device is comprised of a first tube extending along a lower portion of the support surface. A second tube is provided on the bottom of each framework leg and is slidably received in the first tube. A removable retaining pin interconnects the first and second tubes together.

In a third alternative embodiment, each of the mounting devices is comprised of a channel extending along a lower portion of the support surface. The channel is provided with an access opening. A triangular bracket is provided on the bottom of each framework leg having a tubular knuckle received in the access opening of the channel. A removable hinge pin is passed through aligned apertures in the channel and the knuckle.

In another aspect of the invention, an artificial rock climbing arrangement includes a framework having a removable attachment adapted to be connected to a support surface located adjacent a body of water. At least one panel is mounted to the framework for defining a climbing surface, the panel being provided with a series of climbing holds. A support structure is secured to the framework and is adapted to be secured to the support surface for maintaining the framework and the climbing surface in a substantially vertical orientation during use thereof.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
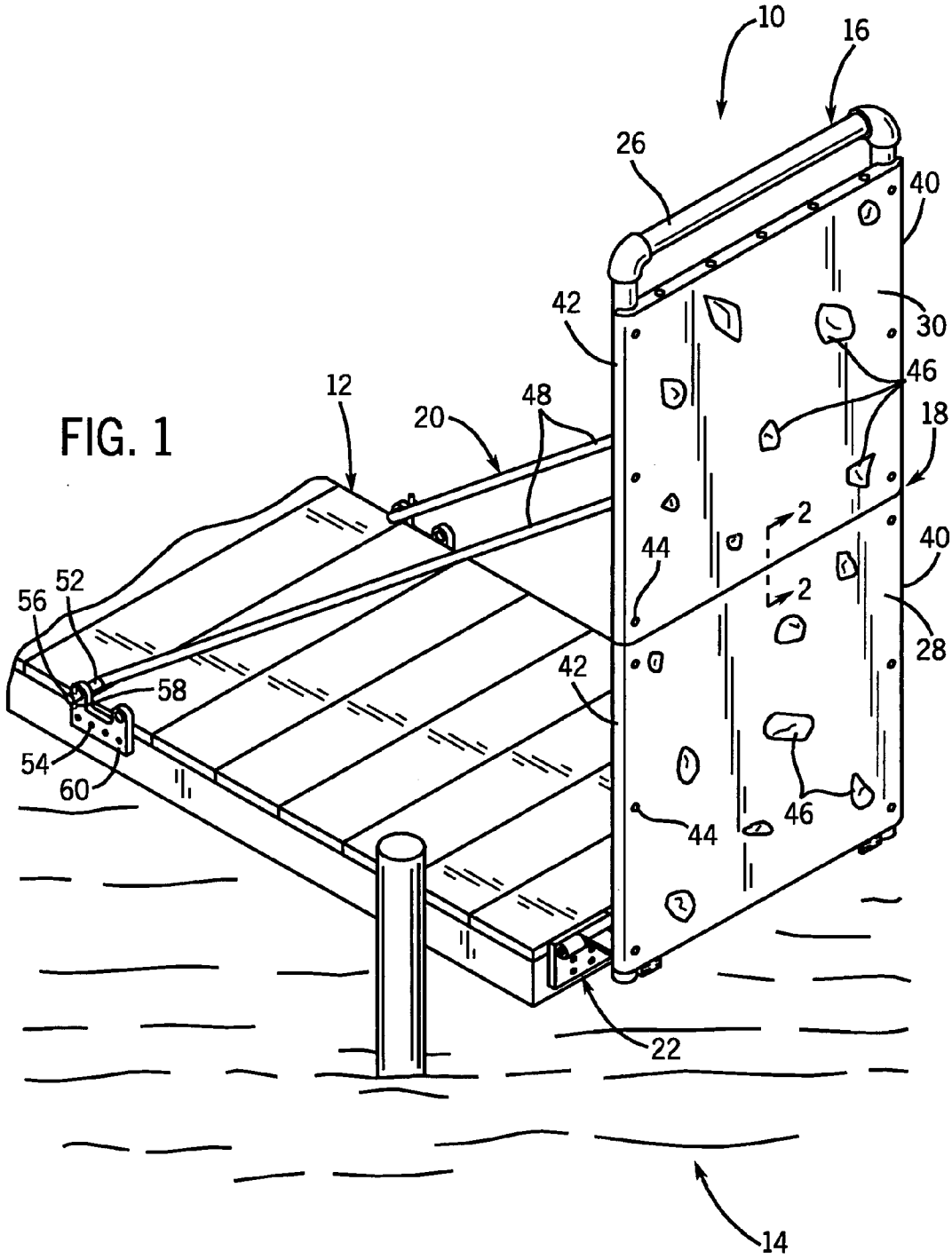
FIG. 1 is a perspective view of an artificial rock climbing arrangement pivotally attached to the end of the pier.
Figure 2:
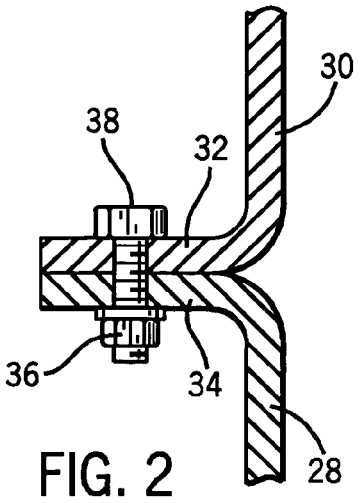
FIG. 2 is a sectional view taken on line 2—2 of FIG. 1.

Referring now to the drawings, FIGS. 1 through 4 illustrate an artificial rock climbing arrangement 10 which is removably attached to a support surface in the form of a pier 12 located adjacent a body of water 14. The rock climbing arrangement 10 is comprised of a generally rigid framework 16, a modular panel structure 18 mounted on the framework 16, support structure 20 between the framework 16 and the sides of the pier 12 for maintaining the framework 16 and panel structure 18 in a substantially vertical climbing orientation and a pair of mounting devices 22 for hingedly coupling the bottom of the framework 16 to the end of the pier 12.

Figure 3:
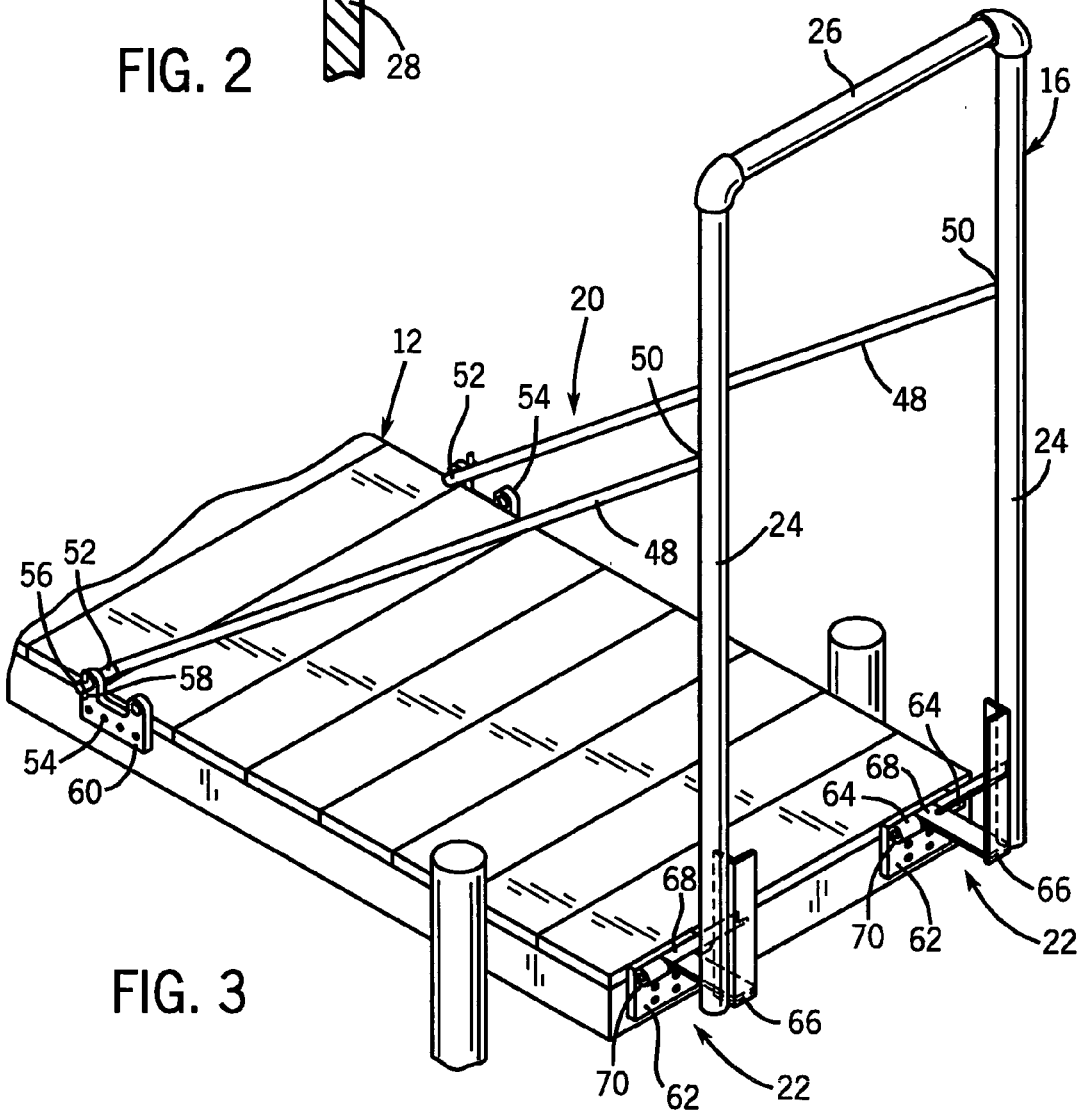
FIG. 3 is a view like FIG. 1 showing the framework of the rock climbing arrangement with the modular panels removed.

As seen in FIG. 3, the framework 16 has an inverted U-shape typically fabricated of aluminum or PVC pipe and includes a pair of parallel legs 24 connected together by a bight portion 26 at the top. The legs 24 provide a mounting surface for the modular panel structure 18 which consists of a plurality of generally square shaped panels 28, 30 that can be added or subtracted depending on the height of the arrangement desired. Each of the two panels 28, 30 shown in FIG. 1 has upper and lower edges shaped as flanges 32, 34 which are predrilled in order to affix the panels 28, 30 together. At least one of the lower edges of panel 30 is joined by fasteners such as nut 36 and bolt 38 (FIG. 2) to the upper edge of an adjacent panel 28 so that the climbing surfaces of the panels define a contiguous climbing area. Alternatively, adhesive may be spread over one or both of the flanges 32, 34 prior to bolting or clamping, or the flanges 32, 34 might be riveted. Each of the panels 28, 30 also has right and left rounded vertical edges 40, 42 which are affixed to the framework legs 24 such as by fasteners 44. A set of commercially available climbing holds 46 is usually removably fastened to the panels 28, 30 so as to establish a particular climbing path. However, some of the climbing hold features may be molded directly into the panels 28, 30 themselves. Each panel 28, 30 may have a flat surface or extend convexly to form the desired climbing surface. The panels 28, 30 can be painted as artificial rock or personalized with murals, figures or other graphic designs. Preferably, the panels 28, 30 will be molded from fiber glass with sufficient structural strength to support the climbing holds 46 and body weight of the climber so that a more complex frame is not needed behind the climbing surface.

The support structure 20 prevents the framework 16 and climbing surface from falling into the water 14. Support structure 20 preferably takes the form of a pair of elongated steel bars 48, although a pair of steel cables might alternatively be implemented. Each bar 48 has a forward end 50 pivotally attached to a leg 24 of the framework 16, and a rearward end 52 removably joined to a connecting plate 54 bolted on the side of the pier 12 behind the framework 16. The rearward end 52 of each bar 48 is typically held in the connecting plate 54 such as by a cotter pin 56 or the like. Each connecting plate 54 defines at least two positions for the rearward end 52 of the bar 48. The back portion 58 shown in FIG. 1 enables the framework 16 and the climbing surface to be held at a substantially 90 degree angle relative to the surface of the pier 12. The front position 60 shown in phantom in FIG. 4 allows the framework 16 and climbing surface to pivot slightly forward of the 90 degree angle via the mounting devices 22 to be discussed in detail below. The front position 60 aids the climber in falling away from the climbing surface so as to avoid contact with the protruding climbing holds 46, and to make the climb more difficult.

Figure 4:
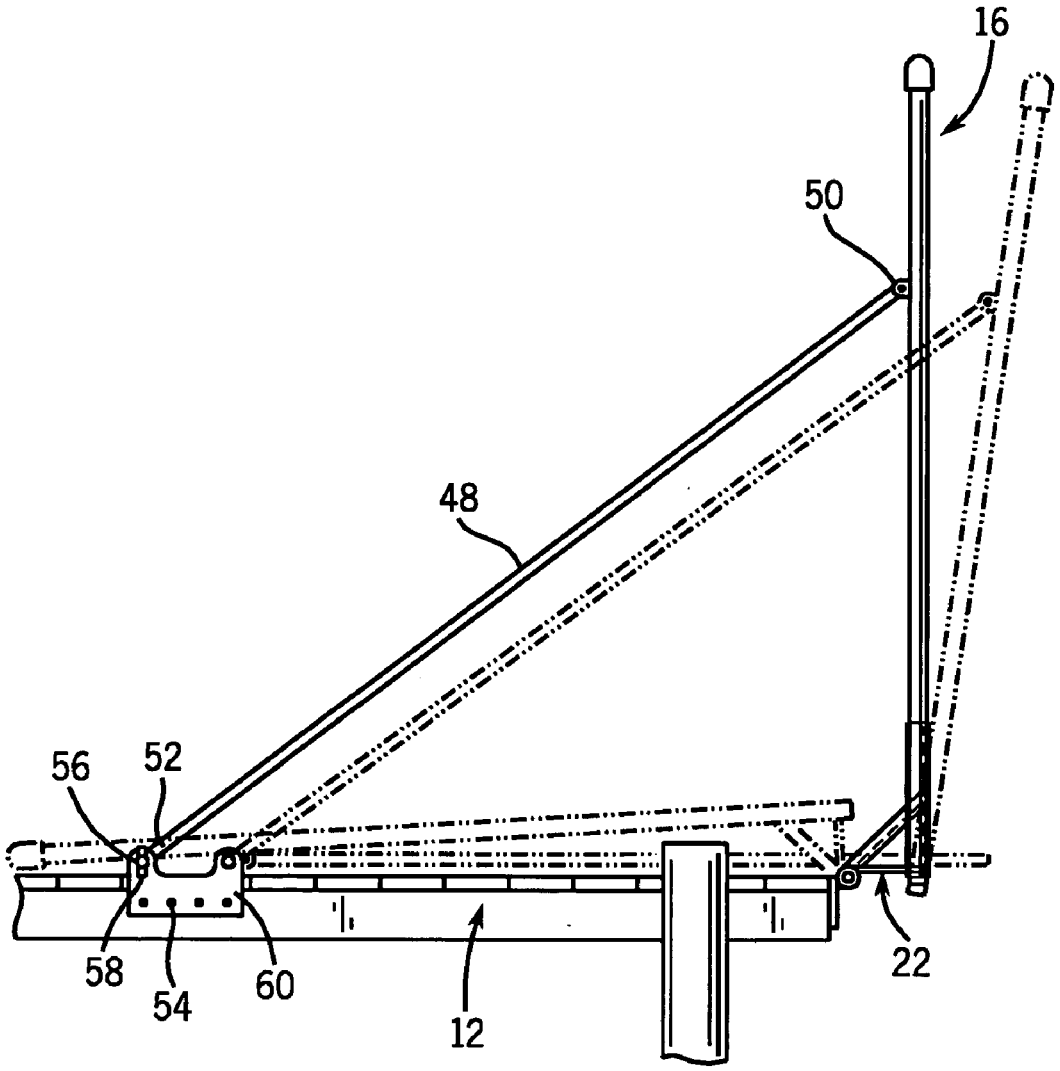
FIG. 4 is a side view of FIG. 1 showing a forwardly tilted position of the rock climbing arrangement in phantom lines.
Figure 10:
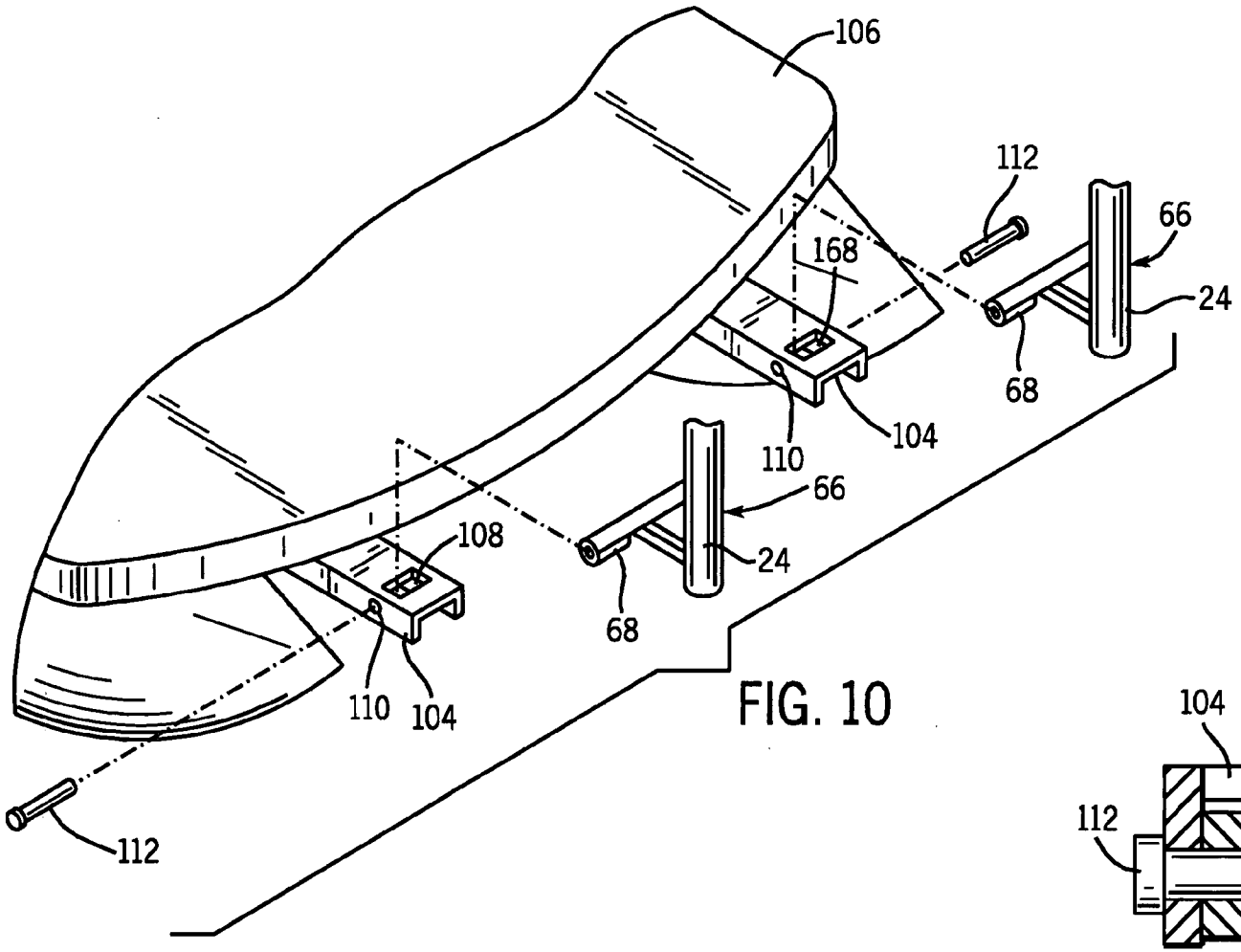
FIG. 10 is a fragmentary, exploded view of the mounting details of the rock climbing arrangement of FIG. 8.

The mounting devices 22 permit pivotable movement of the framework 16 and climbing surface relative to the pier 12, and also facilitate quick installation and decoupling of the framework 16 and the climbing surface from the end of the pier 12. As seen best in FIG. 3, each mounting device 22 includes a mounting plate fastened to the end of the pier 12 and provided with a pair of spaced apart tubular receivers 64. A triangular bracket 66 is attached on the bottom end of each framework leg 24 and is formed with a knuckle 68 (also seen in FIG. 10) which is disposed in alignment between the receivers 64 on the mounting plate 62. A removable headed hinge pin 70 is passed through each set of aligned receivers 64 and knuckle 68. Although not shown, a suitable cotter pin or the like is placed in a protruding end of the hinge pin 70 opposite its head. As discussed above, the mounting devices 22 allow the framework 16 and climbing structure to pivot forward slightly beyond 90 degrees when the support bars 48 are suitably positioned on their connecting plates 54. However, the mounting devices 22 also permit the framework 16 and the climbing surface to be pivoted between a use position and a non-use position. The use position is defined by the framework 16 and climbing surface at either the 90 degree angle or the angle slightly beyond 90 degrees as shown in FIG. 4. The non-use position is defined by the framework 16 and the climbing structure folded rearwardly and downwardly to a horizontal level on top of the pier 12 after the support bars 48 have been uncoupled from their connecting plates 54 and suitably pivoted out of the way. The non-use position is shown in the horizontal phantom lines of FIG. 4.

At this point, it should be readily apparent that installation of the rock climbing arrangement 10 is easily effected by installing the hinge pin 70 in the mounting devices 22 and retaining the rearward ends 52 of the support bars 48 in the connecting plates 54. In use, an individual climber scales the climbing surface along a route defined by the placement of the various climbing holds 46. Typical heights of the climbing surface are 8 or 12 feet depending on the climber's preference. The width of the climbing surface is typically 4 feet. When the climber falls or completes the climbing route, he/she simply falls into the water 14 below. It is noteworthy that unlike other rock climbing structures which necessitate the addition of various pulleys, harnesses, cables, etc. to support the climber, no such belaying system is required by the present invention. When the rock climbing arrangement 10 is not in use, it can be hinged down to the horizontal level. In addition, the hinge pins 70 can be extracted, the support bars 48 can be disconnected and the rock climbing arrangement 10 can be removed from the pier 12.

Figure 5:
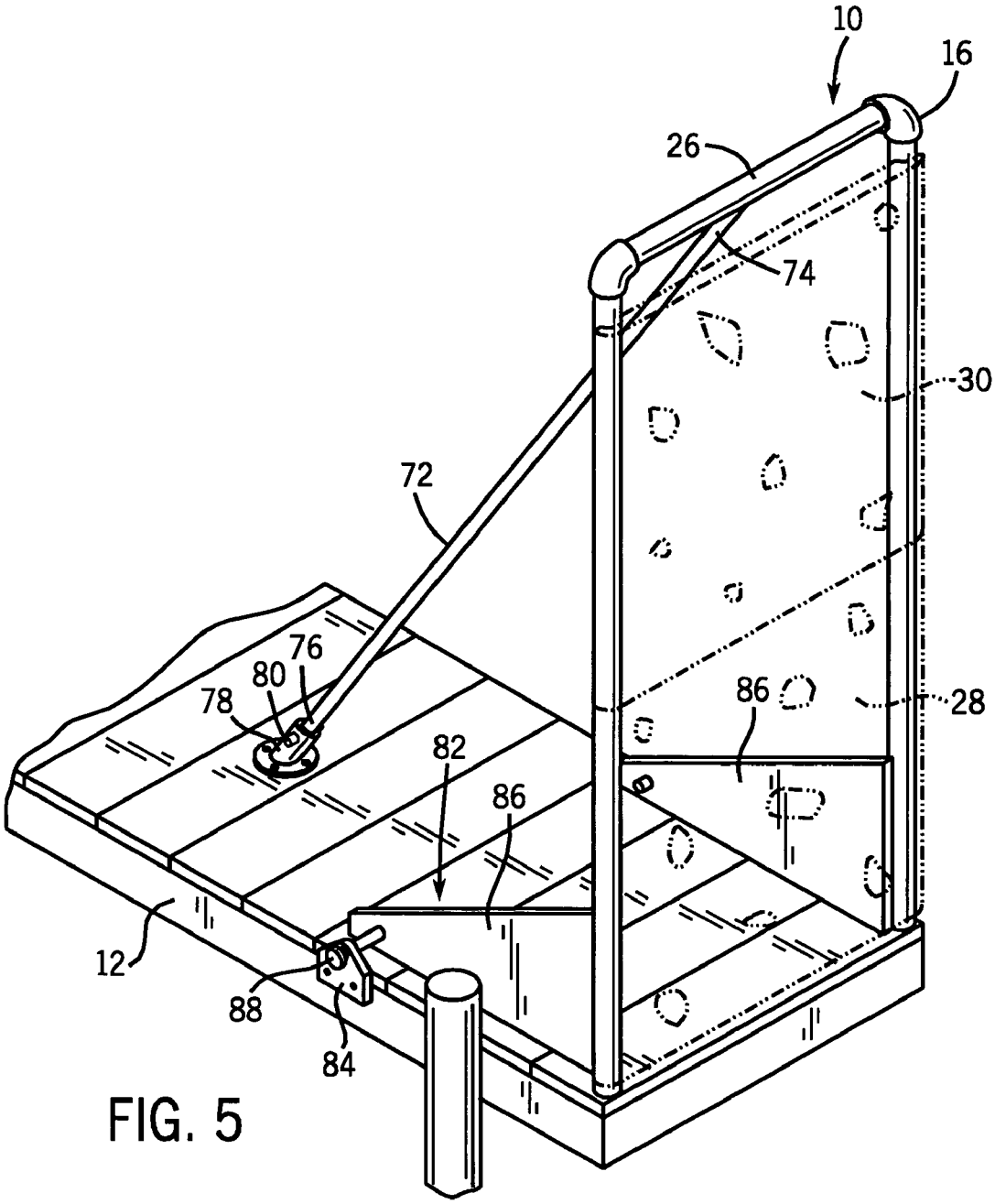
FIG. 5 is a perspective view of a first alternative embodiment of a rock climbing arrangement pivotally attached to the end of a pier.

FIG. 5 shows a first alternative embodiment of the invention. In this version, a single support bar 72 has a forward end 74 pivotally attached to the bight portion 26 of the framework 16, and a rearward end 76 pivotally secured in a receiver 78 on the pier 12 such as by a retainer pin 80. Each mounting device 82 includes a retainer plate 84 fastened on the side of the pier 12, and an extension plate 86 projecting rearwardly on the bottom of each framework leg 24 which rests upon the pier 12. A hinge pin 88 interconnects each retainer plate 84 with its cooperating extension plate 86. This version also provides pivoting movement of the rock climbing arrangement between a use and a non-use position similar to that described in connection with the embodiment of FIGS. 1 through 4.

Figure 6:
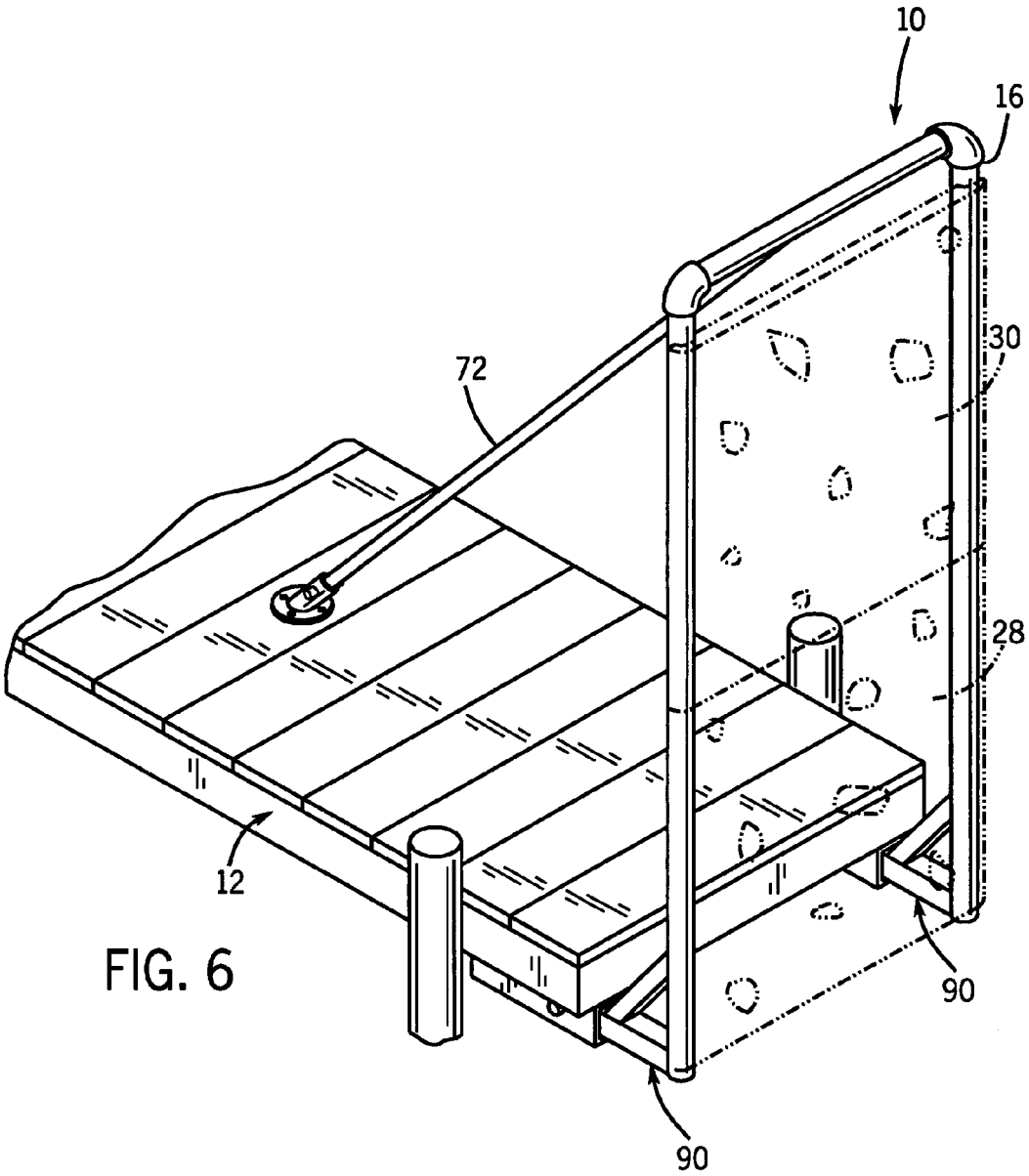
FIG. 6 is a perspective view of a second alternative view of a rock climbing arrangement fixedly mounted to the end of a pier.
Figure 7:
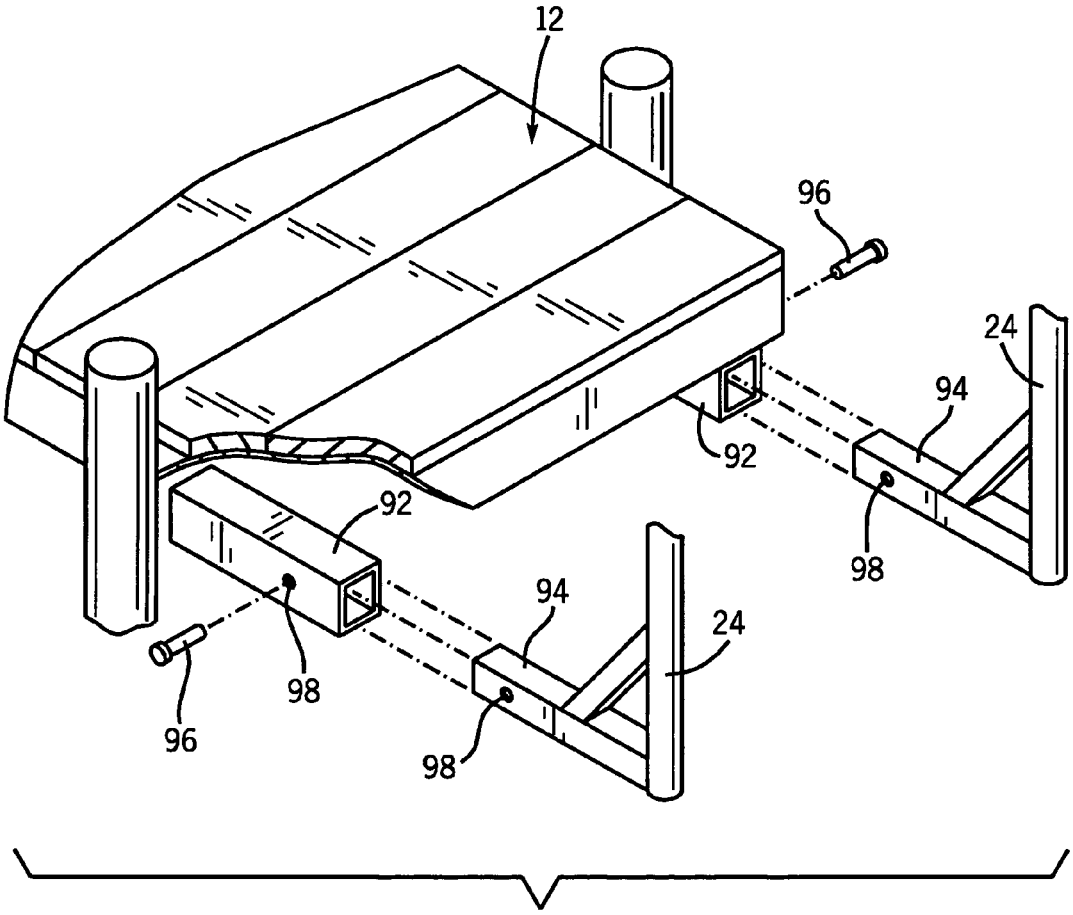
FIG. 7 is a fragmentary, exploded view showing the mounting details of the rock climbing arrangement in FIG. 6.
Figure 8:
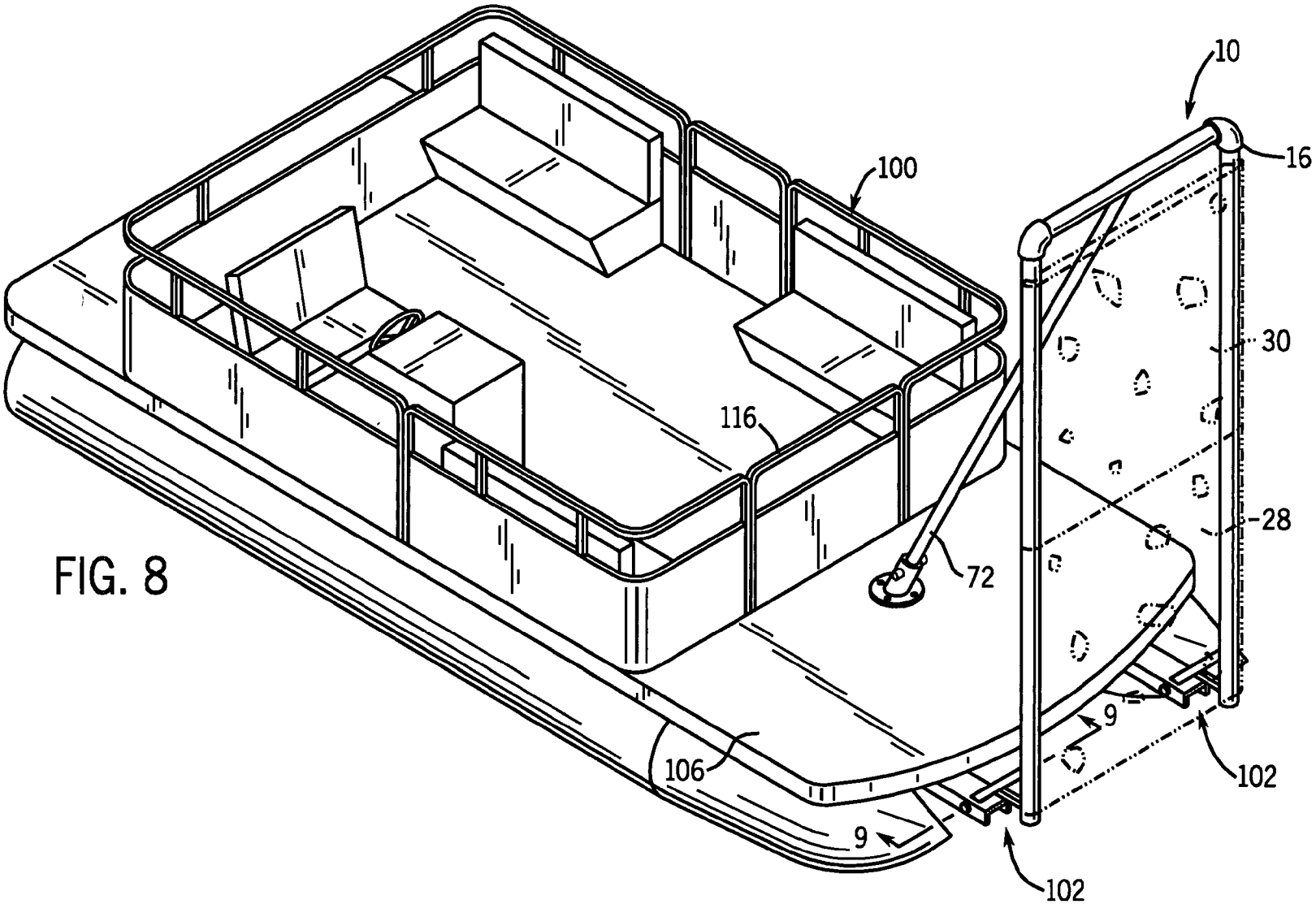
FIG. 8 is a perspective view of a third alternative embodiment of a rock climbing arrangement pivotally mounted to the deck of a pontoon boat.

FIGS. 6 and 7 depict a second alternative embodiment of the invention in which the rock climbing arrangement 10 is non-pivotally mounted to the pier 12. In this version, each mounting device 90 includes a fixed tube 92 anchored along a lower portion of the pier 12 at the forward end thereof. A second tube 94 is provide on the bottom of each framework leg 24 and is slidably received in the first tube 92. A removable retaining pin 96 is passed through aligned apertures 98 in each set of the telescope tubes 92, 94. Suitable means can be provided to hold the retaining pins 96 in place.

Figure 9:
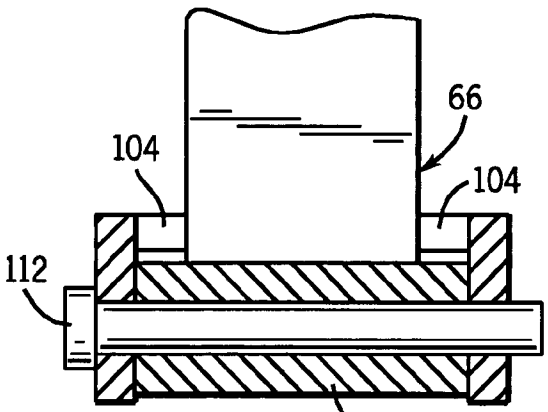
FIG. 9 is a sectional view taken on line 9—9 in FIG. 8.
Figure 11:
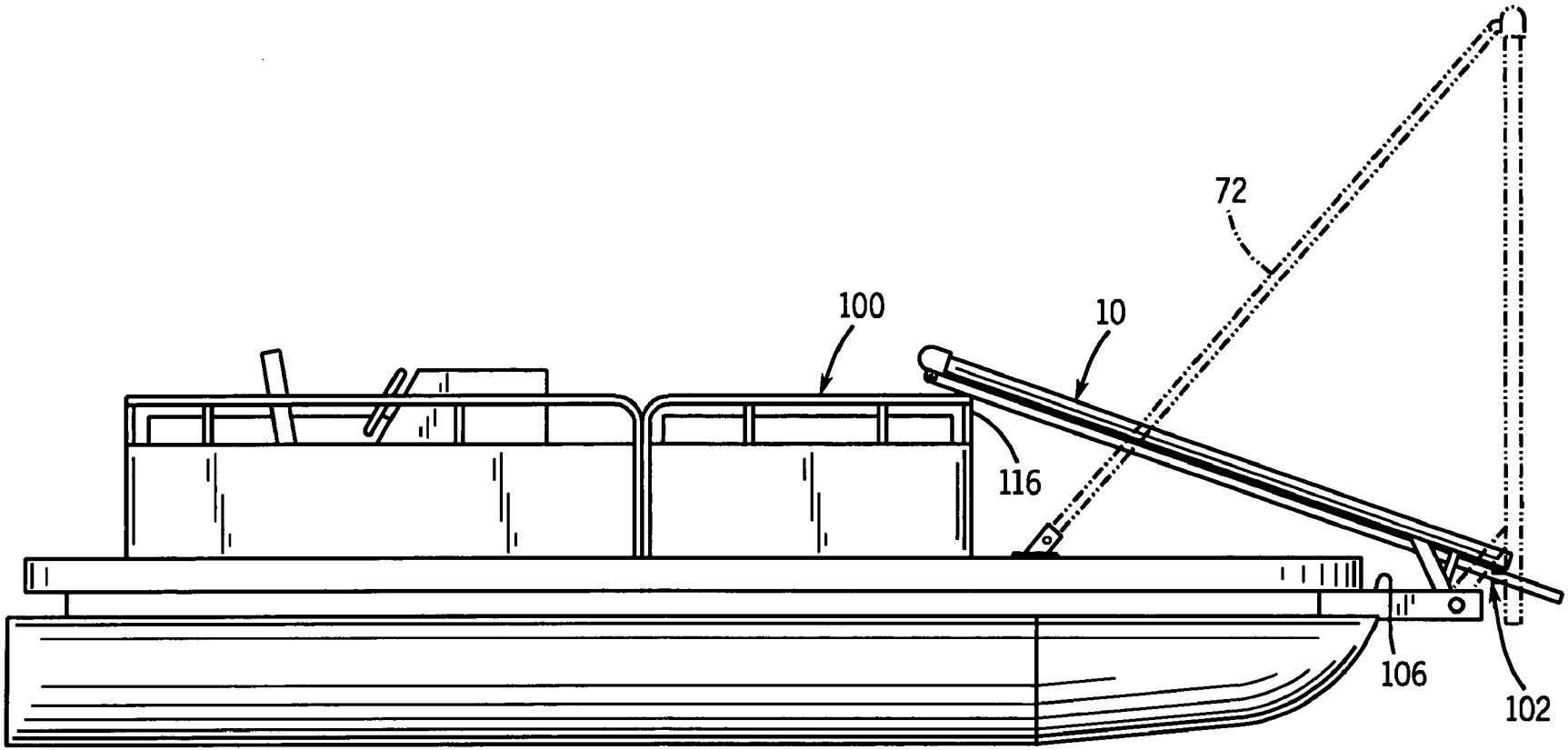
FIG. 11 is a side view of FIG. 8 showing the rock climbing arrangement in a collapsed, non-use position.

FIGS. 8 through 11 disclose a third alternative embodiment of the invention in which the rock climbing arrangement 10 is pivotally mounted to the end of a pontoon boat 100. In this version, each mounting device 102 includes an inverted U-shaped channel 104 extending along a lower portion of the pontoon boat deck 106. Each channel 104 is formed with an access opening 108 in the top surface thereof. Similar to the embodiment of FIGS. 1 through 4, a triangular bracket 66 at the bottom of each framework leg 24 has a tubular knuckle 68. Each knuckle 68 is placed in a respective access opening 108 on the channel 104 so it is aligned with apertures 110 formed in the legs of the channel 104. A removable hinge pin 112 is passed through aligned apertures 110 of the channel 104 and the knuckle 68 (FIG. 9). The end of each hinge pin 112 opposite its head carries a suitable retaining device (not shown). FIG. 11 shows how the rock climbing arrangement 10 is pivoted to a non-use position, in this case, resting upon the railing of the pontoon boat 100.

It should be understood that the rock climbing arrangement 10 is capable of being removably mounted to similar support surfaces adjacent a body of water 14 such as a swimming pool deck, a raft or the like. The rock climbing arrangement 10 may be installed outdoors as described herein, or may be used indoors such as in hotel pools or water parks.

Alternative materials that may be used to make the rock climbing arrangement include polystyrene, roto-cast, plastics, plywood or other man-made composites.

The present invention thus combines water sport recreation with an artificial rock climbing device. The rock climbing arrangement 10 provides a relatively uncomplicated structure which continues to offer a climber a challenging and entertaining climbing experience coupled with the newfound sensation of falling unencumbered into a body of water. The rock climbing arrangement contemplates several different mounting devices, each of which provides for easy set up and knock down by respective insertion and removal of hinge and retainer pins.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention as set forth in the following claims.

I claim:

1. An artificial rock climbing arrangement comprising:

a generally rigid framework removably attached to a support surface located adjacent a body of water;

panel structure mounted on the framework for defining a climbing surface, the panel structure carrying a plurality of climbing holds; and support structure secured between the framework and the support surface for maintaining the framework and the climbing surface in a substantially vertical orientation when a climber scales the climbing surface, wherein the support surface is a pier.

2. The rock climbing arrangement of claim 1, wherein the framework has an inverted U-shape and includes a pair of parallel legs connected together by a bight portion.

3. The rock climbing arrangement of claim 2, wherein the framework legs have bottom ends provided with mounting devices removably secured to an end of the support surface.

4. The rock climbing arrangement of claim 3, wherein the mounting devices permit pivotal movement of the framework and the climbing surface relative to the support surface.

5. The rock climbing arrangement of claim 3, wherein the mounting devices prevent pivotal movement of the framework and the climbing surface relative to the support surface.

6. The rock climbing arrangement of claim 3, wherein each mounting device is comprised of a retainer plate fastened to a side of the support surface, an extension plate projecting rearwardly on the bottom of each framework leg which rests upon the support surface, and a removable hinge pin interconnecting the retainer plate with the extension plate.

7. The rock climbing arrangement of claim 3, wherein each mounting device is comprised of a first tube extending along a lower portion of the support surface, a second tube on the bottom of each framework leg slidably received in the first tube, and a removable retaining pin interconnecting the first and second tubes together.

8. The rock climbing arrangement of claim 3, wherein each mounting device is comprised of a channel extending along a lower portion of the support surface, the channel being provided with an access opening, a triangular bracket on the bottom of each framework leg having a tubular knuckle received in the access opening of the channel, and a removable hinge pin passed through the aligned apertures in the channel and the knuckle.

9. The rock climbing arrangement of claim 2, wherein the panel structure is modular and includes at least two adjacently joined panels removably fastened to the framework, each panel having right and left rounded vertical edges fixed to the framework legs.

10. The rock climbing arrangement of claim 2, wherein the support structure includes a pair of support members, each being connected between one leg of the framework and a connecting plate attached to a side of the support surface behind the framework.

11. The rock climbing arrangement of claim 10, wherein each connecting plate has two positions, one for holding the framework and climbing surface at an angle of substantially 90 degrees relative to the support surface, and another for supporting the framework and climbing surface at an angle beyond 90 degrees relative to the support surface.

12. The rock climbing arrangement of claim 1, wherein the support structure includes a single support member connected between the bight portion of the framework and a receiver located on the support surface behind the framework.

13. The rock climbing arrangement of claim 1, wherein the framework and the climbing surface are movable between a use position and a non-use position.

14. An artificial rock climbing arrangement comprising:

a generally rigid framework removably attached to a support surface located adjacent a body of water;

panel structure mounted on the framework for defining a climbing surface, the panel structure carrying a plurality of climbing holds; and support structure secured between the framework and the support surface for maintaining the framework and the climbing surface in a substantially vertical orientation when a climber scales the climbing surface wherein the support surface is a pontoon boat.

15. An artificial rock climbing arrangement comprising:

a generally rigid framework removably attached to a support surface located adjacent a body of water;

panel structure mounted on the framework for defining a climbing surface, the panel structure carrying a plurality of climbing holds; and support structure secured between the framework and the support surface for maintaining the framework and the climbing surface in a substantially vertical orientation when a climber scales the climbing surface, wherein the framework has an inverted U-shape and includes a pair of parallel legs connected together by a bight portion, wherein the framework legs have bottom ends provided with mounting devices removably secured to an end of the support surface, and wherein each mounting device is comprised of a mounting plate attached to the end of the support surface, the mounting plate having a pair of spaced apart tubular receivers, a triangular bracket on the bottom of each framework leg having a tubular knuckle disposed between the receivers on the mounting plate and a removable hinge pin passed through the aligned receivers and knuckle.

* * * * *